US008813957B1

(12) United States Patent
Kao

(10) Patent No.: US 8,813,957 B1
(45) Date of Patent: Aug. 26, 2014

(54) POSITIONING FRAME FOR SOCKET BITS

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 13/855,827

(22) Filed: Apr. 3, 2013

(51) Int. Cl.
*B65D 85/72* (2006.01)
*B65D 73/00* (2006.01)

(52) U.S. Cl.
USPC ..... 206/378; 206/493

(58) Field of Classification Search
USPC ..... 211/43, 184, 69, 175, 94.01, 70.6; 206/378, 493, 594; 248/500, 220.21, 248/223.41, 225.11
See application file for complete search history.

(56) References Cited

U.S. PATENT DOCUMENTS 4,406,372 A * 9/1983 Bell ..... 206/566
5,217,115 A * 6/1993 Purkapile ..... 206/373
5,560,498 A * 10/1996 Porter ..... 211/20
5,573,116 A * 11/1996 Zink ..... 206/378
6,145,662 A * 11/2000 Newton ..... 206/373
2008/0047911 A1 * 2/2008 Kao ..... 211/70.6

* cited by examiner

*Primary Examiner* — Jonathan Liu
*Assistant Examiner* — James Twomey
(74) *Attorney, Agent, or Firm* — Alan D. Kamrath; Kamrath IP Lawfirm, P.A.

(57) ABSTRACT

A positioning frame for socket bits has a track frame and a supporting device. The track frame has at least one baseboard, at least two positioning racks and at least two holding racks. The racks are formed on the at least one baseboard. Each one of the at least two holding racks has a holding recess and an opening. The supporting device is detachably connected to the track frame and has multiple fixing boards and at least two supporting mounts. The fixing boards are movably mounted in the holding recesses of the at least two holding racks. The at least two supporting mount are securely connected to the fixing boards to abut against the at least one baseboard, and each one of the at least two supporting mounts has at least two through holes and at least two screw bolts.

9 Claims, 17 Drawing Sheets

POSITIONING FRAME FOR SOCKET BITS

BACKGROUND OF THE INVENTION

1. Field of the Invention

The present invention relates to a positioning frame and, more particularly, to a positioning frame for socket bits that can provide an enhanced structural strength and that can be used conveniently.

2. Description of the Prior Art

A conventional positioning frame for socket bits has a track frame, a handle and multiple positioning blocks. The track frame is made by aluminum extrusion and has a periphery, a surface and multiple racks. The racks are formed in the surface of the track frame at intervals. The handle is mounted on the periphery of the track frame. The positioning blocks are slidably mounted in the racks of the track frame. The user can store and display the socket bits by mounting the socket bits around the positioning blocks.

Though the conventional positioning frame for socket bits can position the socket bits for storage purposes, the handle is exposed out of the track frame, such that the whole volume of the conventional positioning frame is increased. The user needs a large space to store the conventional positioning frame, and this is inconvenient both in storage and use. In addition, when the conventional positioning frame is used to store a lot of socket bits or heavy tools, the structural strength of the conventional positioning frame cannot bear the weight of the socket bits or the tools and may be distorted.

To overcome the shortcomings, the present invention provides a positioning frame for socket bits to mitigate the aforementioned problems.

SUMMARY OF THE INVENTION

The main objective of the present invention is to provide a positioning frame for socket bits that can provide an enhanced structural strength and that can be used conveniently.

The positioning frame for socket bits in accordance with the present invention has a track frame and a supporting device. The track frame has at least one baseboard, at least two positioning racks and at least two holding racks. The racks are formed on the at least one baseboard. Each one of the at least two holding racks has a holding recess and an opening. The supporting device is detachably connected to the track frame and has multiple fixing boards and at least two supporting mounts. The fixing boards are movably mounted in the holding recesses of the at least two holding racks. The at least two supporting mounts are securely connected to the fixing boards to abut against the at least one baseboard, and each one of the at least two supporting mounts has at least two through holes and at least two screw bolts.

Other objectives, advantages and novel features of the invention will become more apparent from the following detailed description when taken in conjunction with the accompanying drawings.

DETAILED DESCRIPTION OF THE PREFERRED EMBODIMENTS

With reference to FIGS. 1 to 4, a first embodiment of a positioning frame for socket bits in accordance with the present invention has a track frame 10 and a supporting device 20.

Figure 1:
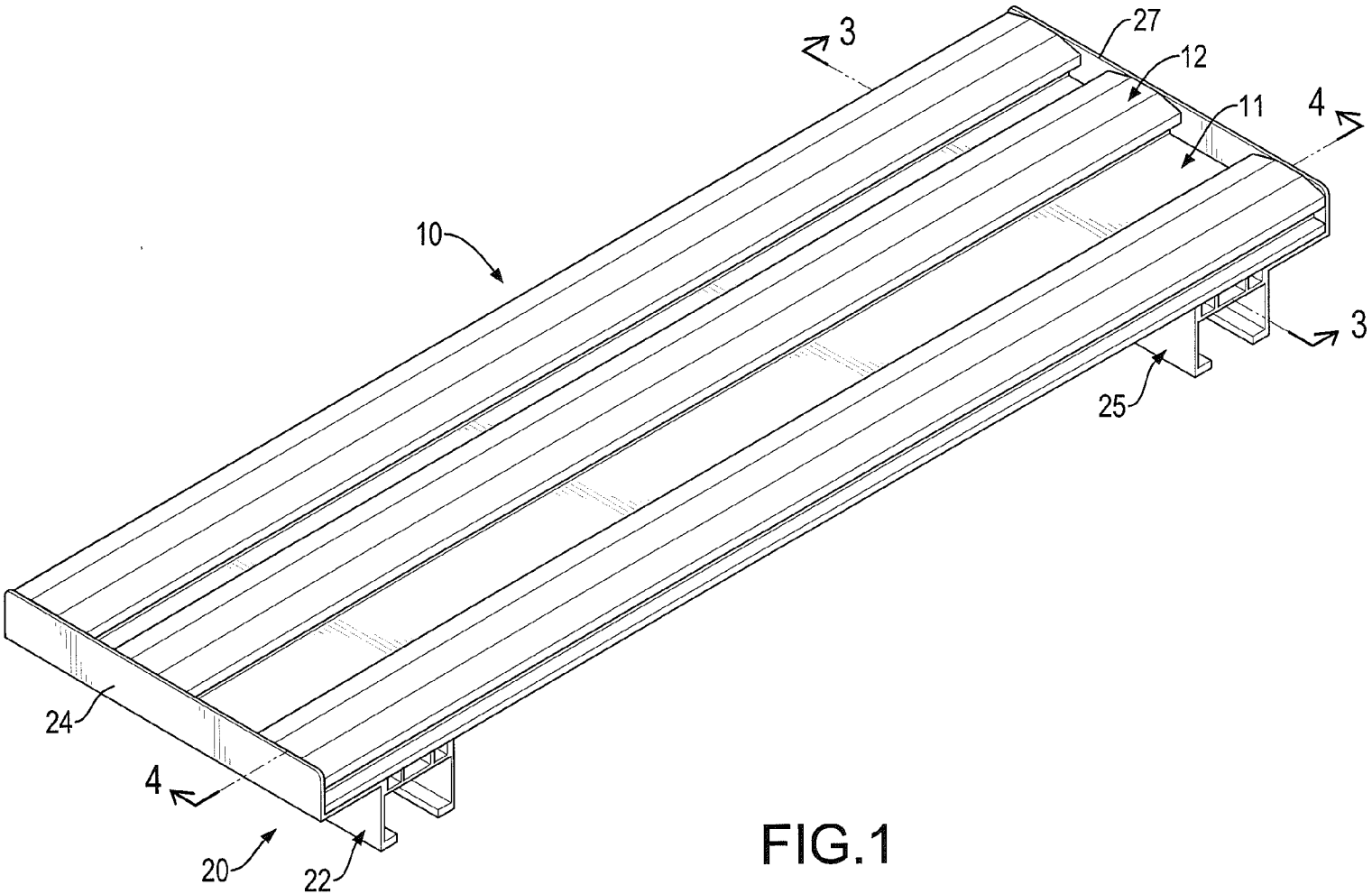
FIG. 1 is a perspective view of a first embodiment of a positioning frame in accordance with the present invention.
Figure 2:
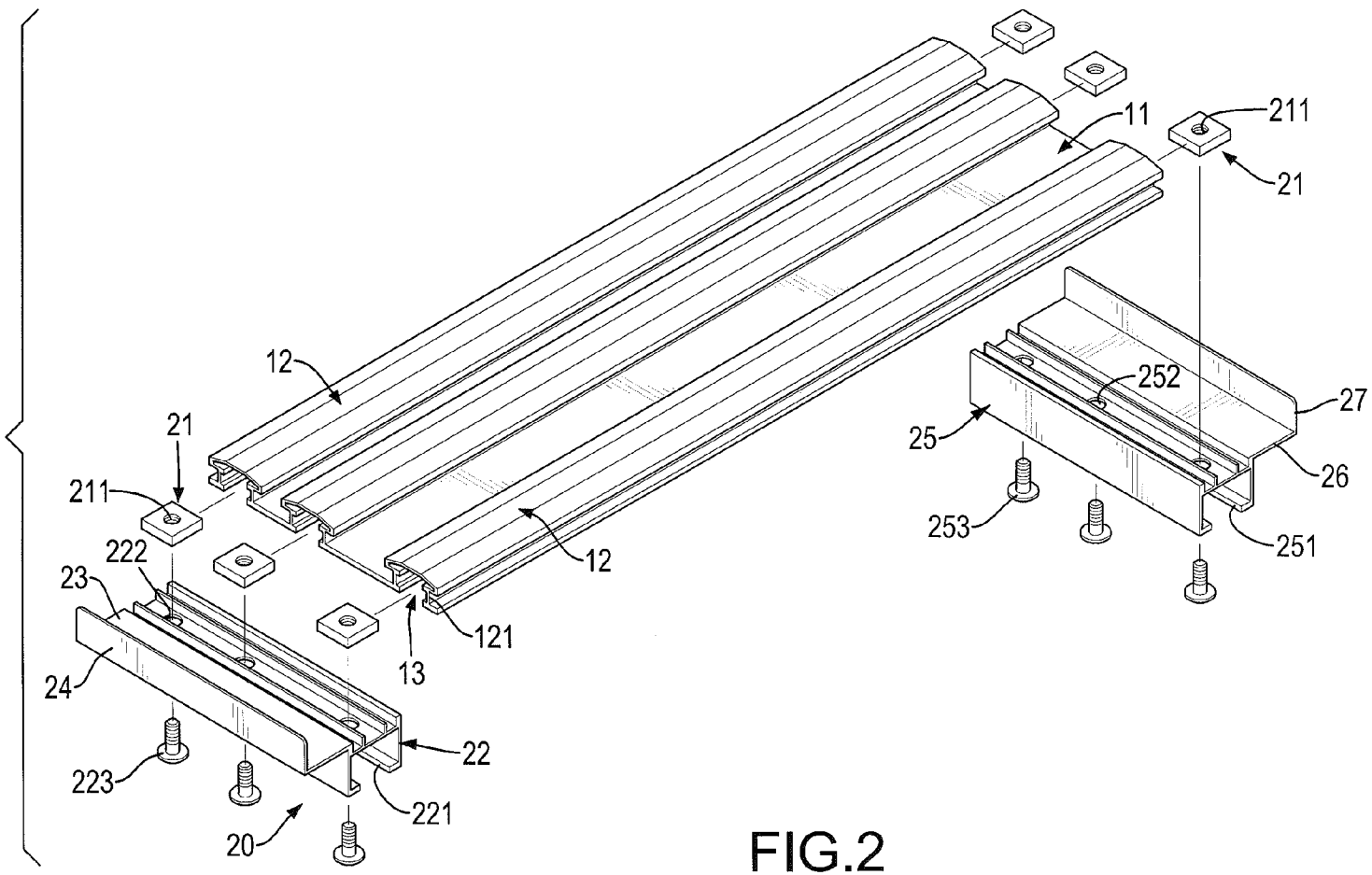
FIG. 2 is an exploded perspective view of the positioning frame in FIG. 1.
Figure 3:
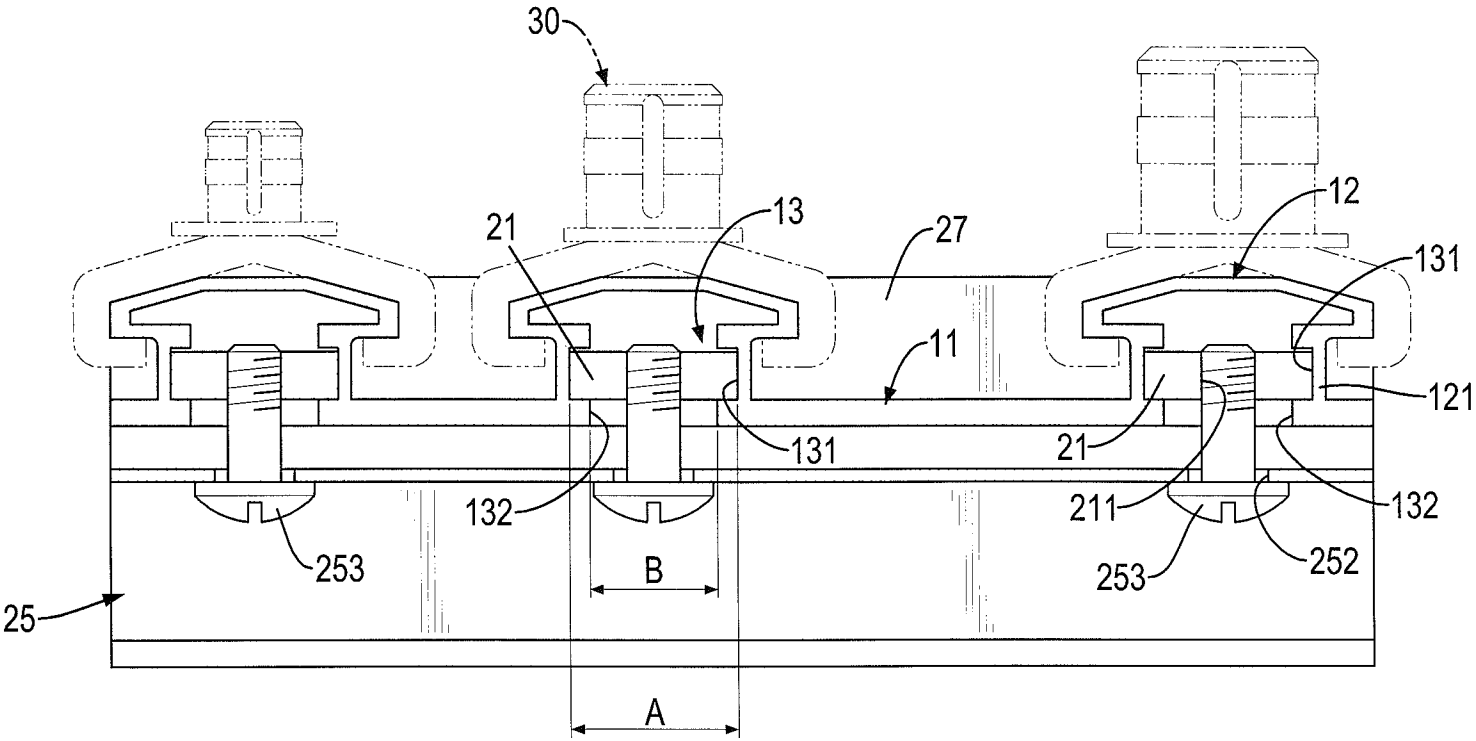
FIG. 3 is an enlarged cross sectional view in partial section of the positioning frame across line 3-3 in FIG. 1.
Figure 4:
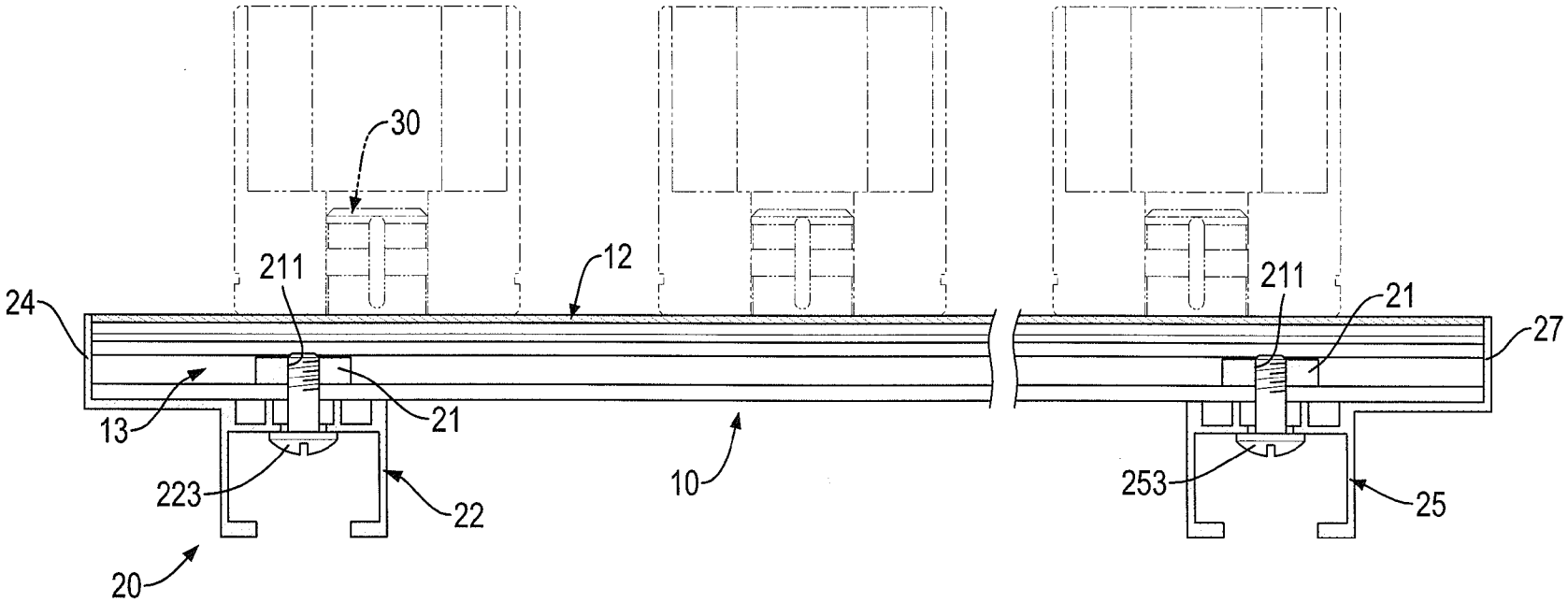
FIG. 4 is another enlarged side view in partial section of the positioning frame across line 4-4 in FIG. 1.

The track frame 10 is made by aluminum extrusion, is elongated and has a baseboard 11, multiple positioning racks 12 and multiple holding racks 13. The baseboard 11 may be rectangular in shape and has a top surface, a bottom surface, two opposite sides and a length. The positioning racks 12 may be hollow, and are formed on and protrude from the top surface of the baseboard 11 at intervals, and each positioning rack 12 has a length, a bottom side, two opposite sidewalls and two clamping slots 121. The length of the positioning rack 12 is equal to the length of the baseboard 11. The clamping slots 121 are respectively formed in the opposite sidewalls of the positioning rack 12 above the bottom side of the positioning rack 12. Preferably, the track frame 10 has three positioning racks 12 formed on and protruding from the top surface of the baseboard 11. With further reference to FIGS. 3 and 4, multiple positioning blocks 30 can be mounted slidably on and clamp the positioning racks 12 of the track frame 10 to hold socket bits on the track frame 10.

The holding racks 13 are respectively formed in the positioning racks 12, and each holding rack 13 has a bottom side, a length, a holding recess 131 and an opening 132. The length of the holding rack 13 is equal to the length of the baseboard 11. The holding recess 131 is formed in a corresponding positioning rack 12 and has a width (A). The opening 132 is formed through the bottom side of the holding rack 13, communicates with the holding recess 131 and has a width (B). The width (A) of the holding recess 131 is wider than the width (B) of the opening 132.

The supporting device 20 is detachably connected to the track frame 10 and has multiple fixing boards 21, a first supporting mount 22 and a second supporting mount 25. The fixing boards 21 may be quadrate, and are movably mounted in the holding recesses 131 of the holding racks 13 adjacent to the opposite sides of the baseboard 11. Each fixing board 21 has a fixing hole 211 formed through the fixing board 21 and communicating with the opening 132 of a corresponding holding rack 13. Since the width (A) of the holding recess 131 is wider than the width (B) of the opening 132, the fixing boards 21 will not depart from the holding recesses 131 of the holding racks 13 via the openings 132.

The first supporting mount 22 may be square, is made by aluminum extrusion and is connected to the bottom surface and one of the opposite sides of the baseboard 11. The first supporting mount 22 has a top, a bottom, an outer side, a through opening 221, multiple through holes 222, multiple screw bolts 223, an extending tab 23 and a side panel 24. The through opening 221 is elongated and is formed through the bottom of the first supporting mount 22. The through holes 222 are formed through the top of the first supporting mount 22 at intervals, communicate with the through opening 221 and respectively align with the fixing holes 211 of the fixing boards 21 that are mounted on the same one of the opposite sides of the baseboard 11 as the first supporting mount 22. The screw bolts 223 are respectively mounted through the through holes 222 of the first supporting mount 22 via the through opening 221 and are respectively and securely mounted in the fixing holes 211 of the fixing boards 21 via the openings 132 of the holding racks 13 to connect the first supporting mount 22 securely with the fixing boards 21 at one of the opposite sides of the baseboard 11 and to connect the first supporting mount 22 securely at the bottom surface of the baseboard 11.

The extending tab 23 is formed on and transversally protrudes from the outer side of the first supporting mount 22 at the top of the first supporting mount 22, abuts the bottom surface of the baseboard 11 and has an outer side. The side panel 24 is formed on and upwardly protrudes from the outer side of the extending tab 23 to close the positioning racks 12 and the holding racks 13 at the same one of the opposite sides of the baseboard 11 as the first supporting mount 22 to prevent the fixing boards 21 from separating from the corresponding one of the opposite sides of the baseboard 11.

The second supporting mount 25 may be square, is made by aluminum extrusion and is connected to the bottom surface and the other one of the opposite sides of the baseboard 11. The second supporting mount 25 has a top, a bottom, an outer side, a through opening 251, multiple through holes 252, multiple screw bolts 253, an extending tab 26 and a side panel 27. The through opening 251 is elongated and is formed through the bottom of the second supporting mount 25. The through holes 252 are formed through the top of the second supporting mount 25 at intervals, communicate with the through opening 251 and respectively align with the fixing holes 211 of the fixing boards 21 that are mounted on the same one of the opposite sides of the baseboard 11 as the second supporting mount 25. The screw bolts 253 are respectively mounted through the through holes 252 of the second supporting mount 25 via the through opening 251 and are respectively and securely mounted in the fixing holes 211 of the fixing boards 21 via the openings 132 of the holding racks 13 to connect the second supporting mount 25 securely with the fixing boards 21 at the other one of the opposite sides of the baseboard 11 and to connect the second supporting mount 25 securely at the bottom surface of the baseboard 11. Accordingly, the supporting mounts 22, 25 are respectively connected to the opposite sides of the baseboard 11.

The extending tab 26 is formed on and transversally protrudes from the outer side of the second supporting mount 25, is formed at the top of the second supporting mount 25, abuts the bottom surface of the baseboard 11 and has an outer side. The side panel 27 is formed on and upwardly protrudes from the outer side of the extending tab 26 to close the positioning racks 12 and the holding racks 13 at the same one of the opposite sides of the baseboard 11 as the second supporting mount 25 to prevent the fixing boards 21 from separating from the corresponding one of the opposite sides of the baseboard 11.

With reference to FIGS. 1 to 4, the first supporting mount 22 and the second supporting mount 25 are respectively connected to the opposite sides of the baseboard 11 to reinforce the structural strength of the track frame 10. Preferably, the supporting device 20 may have another supporting mount mounted on the bottom surface of the baseboard 11 between the first supporting mount 22 and the second supporting mount 25 to further reinforce the structural strength of the track frame 10. In addition, the supporting mounts 22, 25 are mounted on and protrude from the bottom surface of the baseboard 11, and this can provide a space between the supporting mounts 22, 25 and the bottom surface of the baseboard 11. Then, the positioning frame for socket bits can be held upward by a user inserting fingers into the space between the supporting mounts 22, 25 and the bottom surface of the baseboard 11 without using the handle of the conventional positioning frame, and this can reduce the whole volume of the positioning frame in storage.

Furthermore, the track frame 10 is made by aluminum extrusion and may have multiple sharp points formed at the positioning racks 12 and the holding racks 13. The side panels 24, 27 of the supporting mounts 22, 25 are used to close the positioning racks 12 and the holding racks 13 to prevent the user from getting hurt by touching the ends of the positioning racks 12 and the holding racks 13, and this can improve the safety in use. In addition, the side panels 24, 27 of the supporting mounts 22, 25 also can prevent the positioning blocks 30 that are mounted around the positioning racks 12 from separating from the rack frame 10.

Additionally, the screw bolts 223, 253 can be loosened to form a gap between the corresponding supporting mounts 22, 25, the corresponding fixing boards 21 and the holding racks 13 to enable the supporting mounts 22, 25 to push the fixing boards 21 to move in the holding recesses 131 of the track frame 10. Then, the distance between the supporting mounts 22, 25 can be adjusted according to the user's need.

Figure 5:
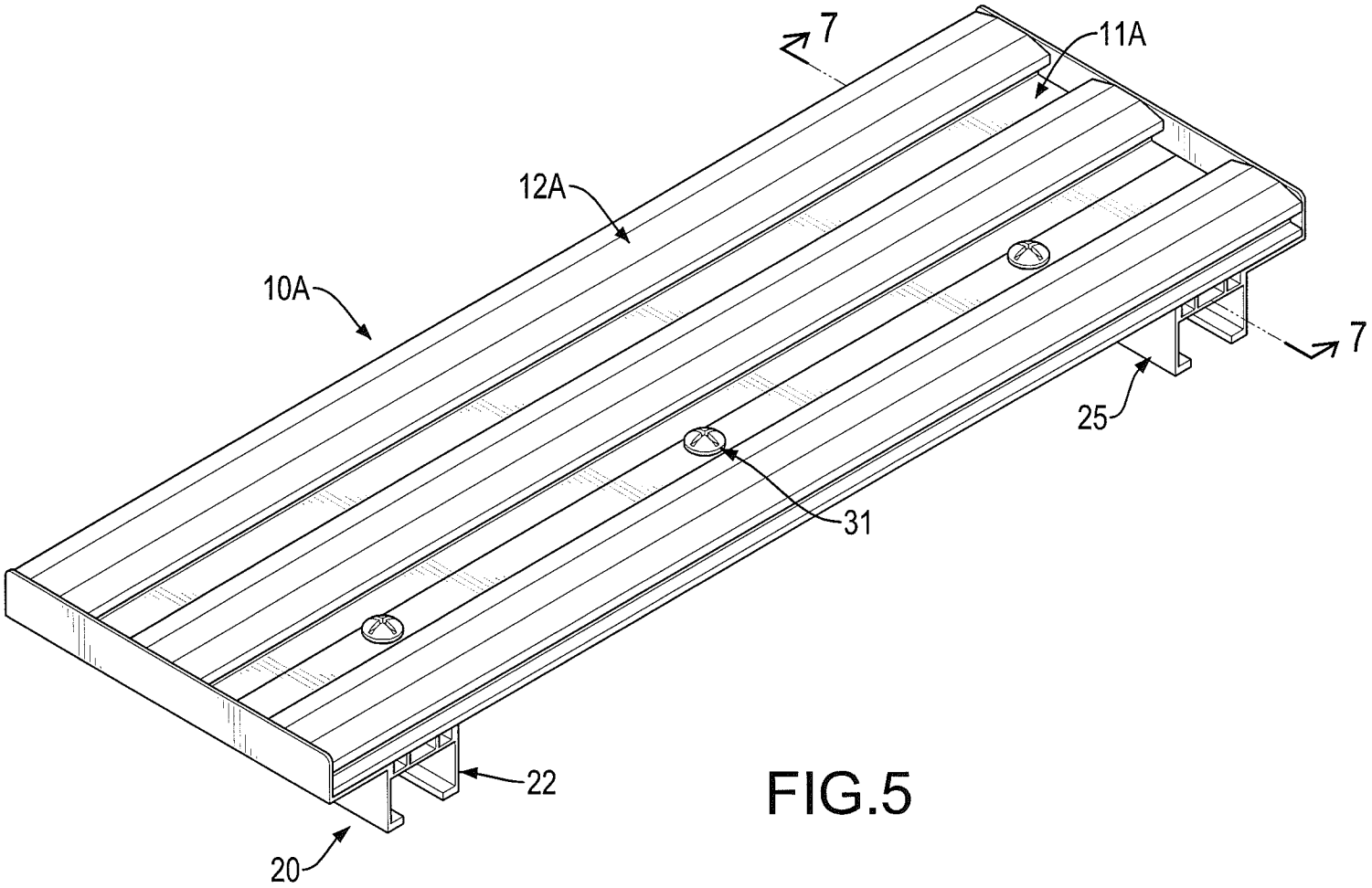
FIG. 5 is a perspective view of a second embodiment of a positioning frame in accordance with the present invention.
Figure 6:
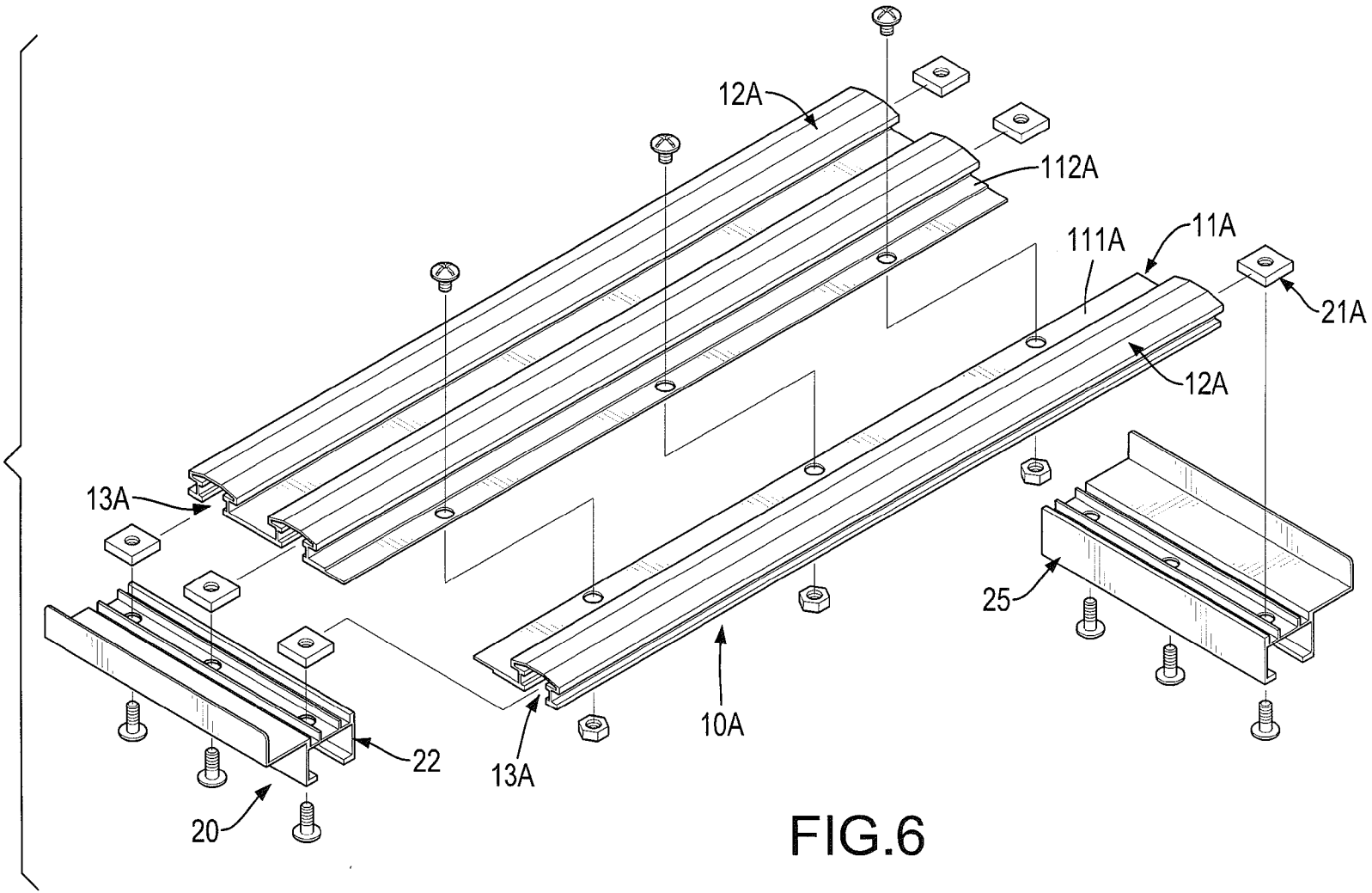
FIG. 6 is an exploded perspective view of the positioning frame in FIG. 5.
Figure 7:
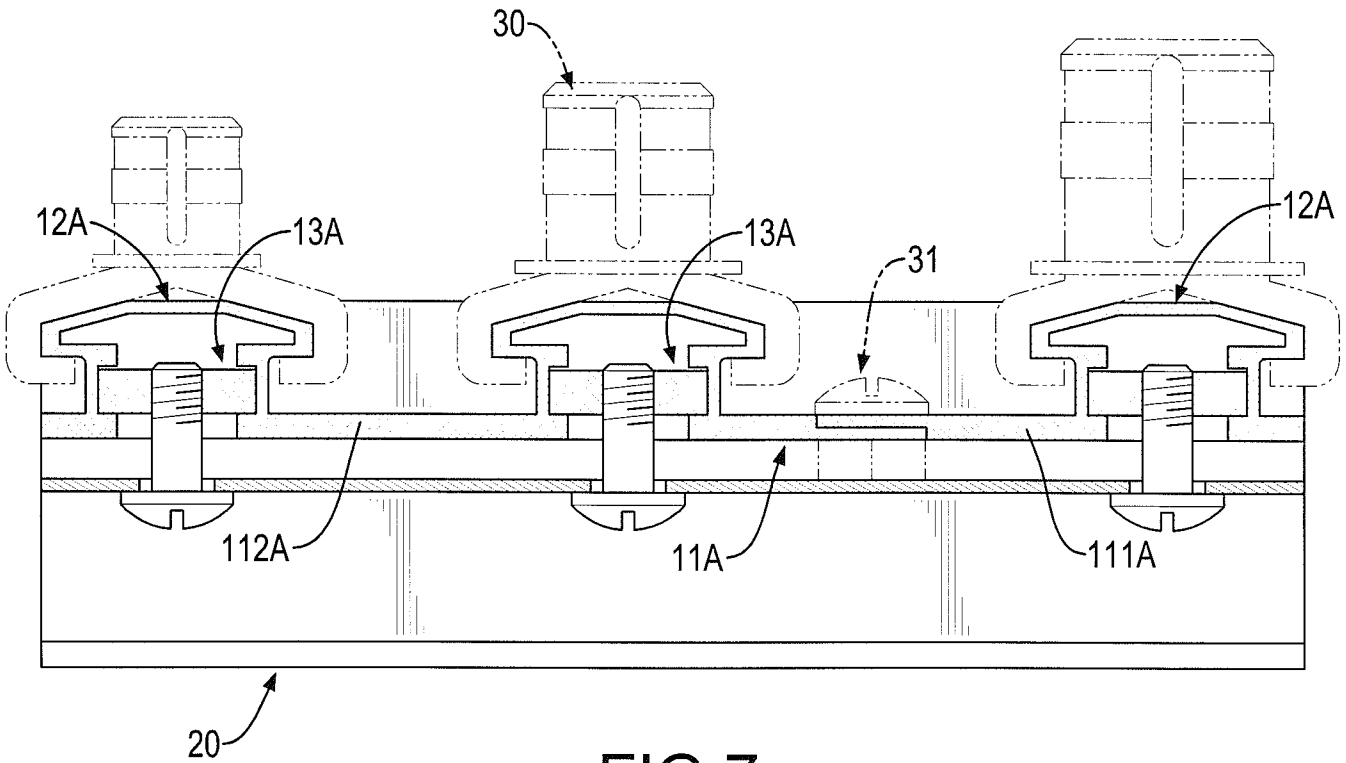
FIG. 7 is an enlarged cross sectional view in partial section of the positioning frame across line 7-7 in FIG. 5.
Figure 8:
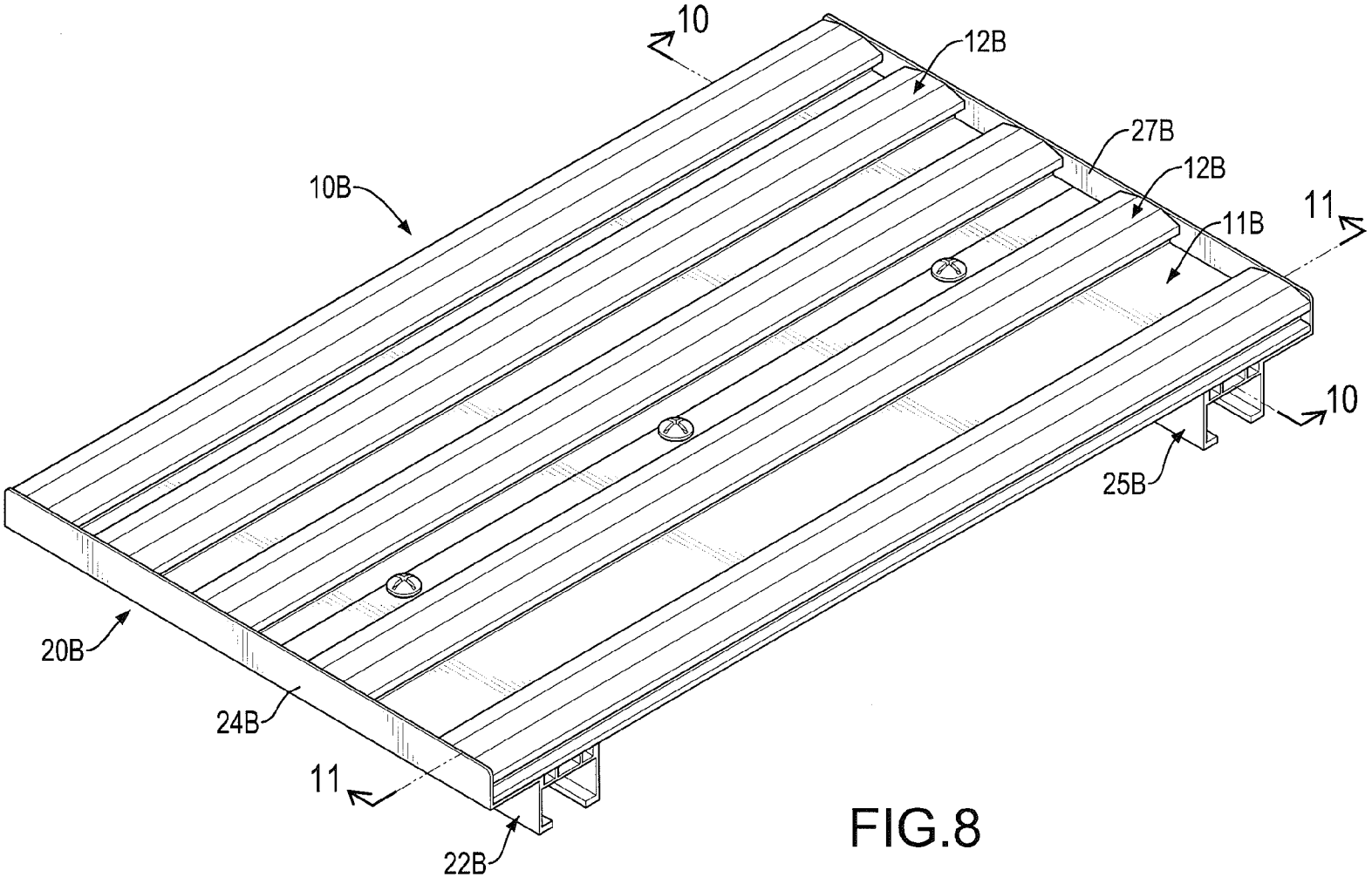
FIG. 8 is a perspective view of a third embodiment of a positioning frame in accordance with the present invention.
Figure 9:
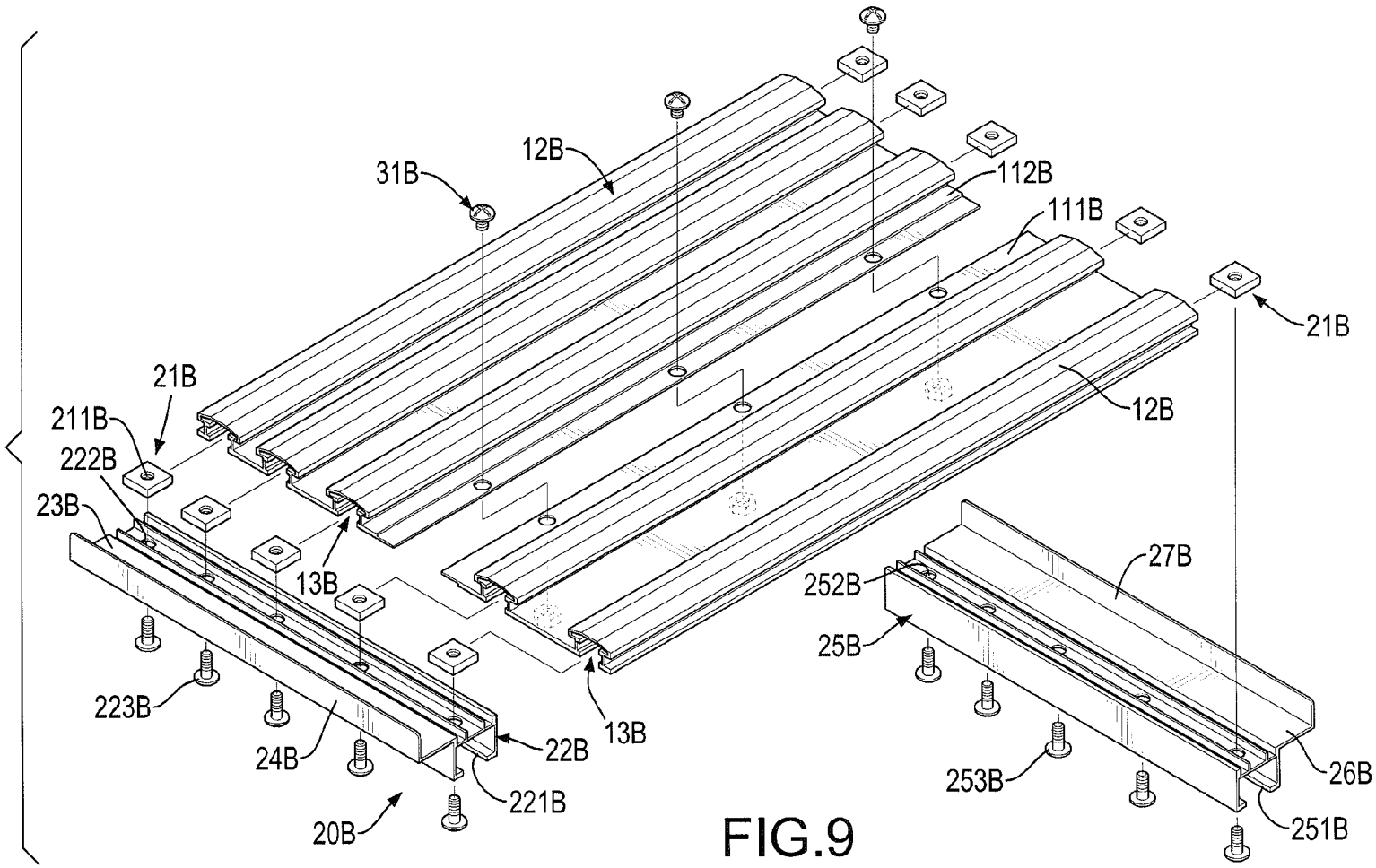
FIG. 9 is an exploded perspective view of the positioning frame in FIG. 8.
Figure 10:
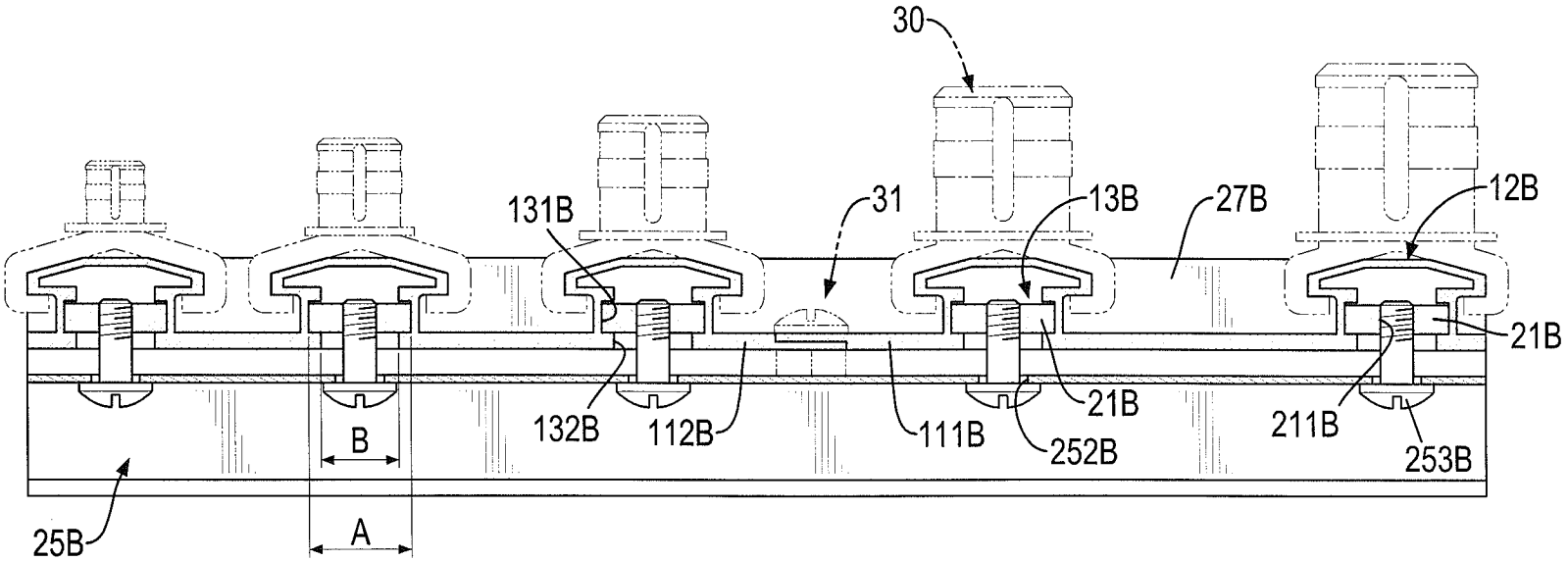
FIG. 10 is an enlarged cross sectional view in partial section of the positioning frame across line 10-10 in FIG. 8.
Figure 11:
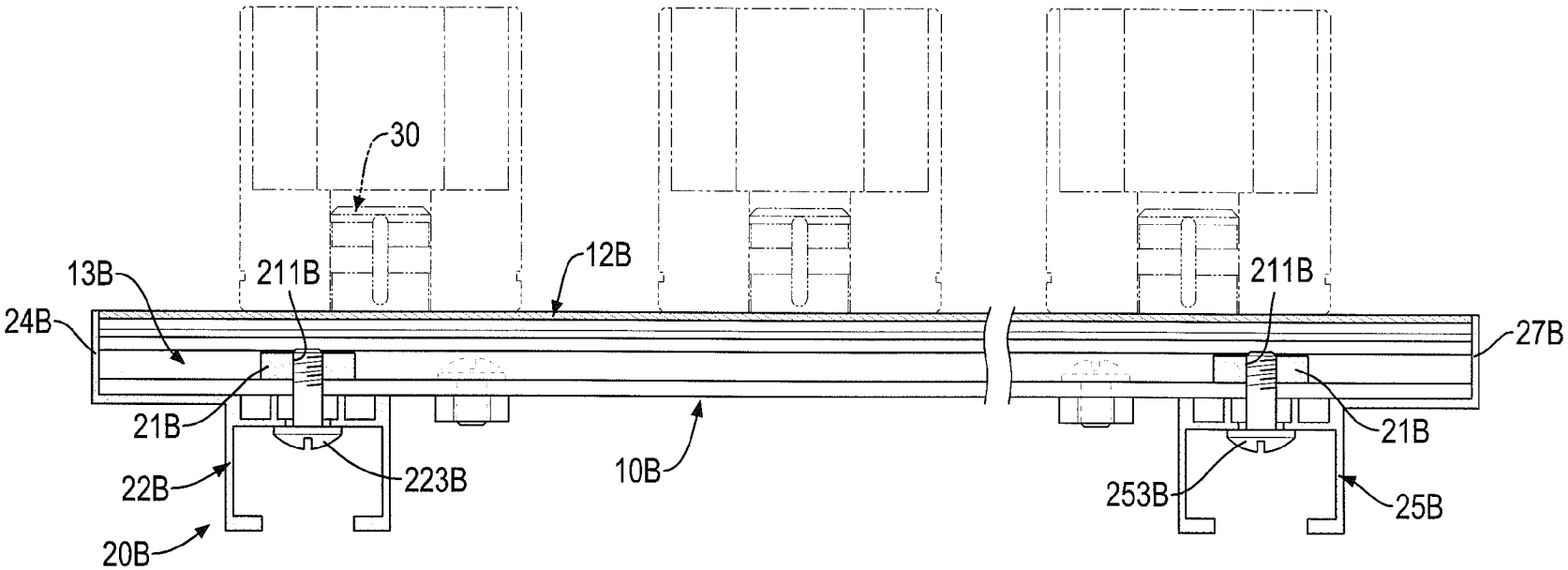
FIG. 11 is another enlarged cross sectional view in partial section of the positioning frame across line 11-11 in FIG. 8.

With reference to FIGS. 5 to 7, a second embodiment of a positioning frame for socket bits has similar structures substantially the same as the structures in the above-mentioned first embodiment of the positioning frame except the track frame 10A has two baseboards 11A. Each baseboard 11A has an inner side and a connecting wing 111A, 112A. The connecting wing 111A, 112A is formed on and protrudes transversally from the inner side of the baseboard 11A. The connecting wings 111A, 112A are stacked together and are securely connected to each other by multiple bolt-nut sets 31.

The structural relationships and the positions of the positioning racks 12A, the holding racks 13A, and the fixing boards 21A of the second embodiment of the positioning frame are substantially the same as the structures in the above-mentioned first embodiment of the positioning frame. Preferably, one of the positioning racks 12A is formed on and protrudes from one of the baseboards 11A, and the other positioning racks 12A are formed on and protrude from the other baseboard 11A.

With reference to FIGS. 8 to 13, a third embodiment of a positioning frame for socket bits has similar structures substantially the same as the structures in the above-mentioned second embodiment of the positioning frame except the track frame 10B has five positioning racks 12B and has five holding racks 13B each having the holding recess 131B and the opening 132B. The positioning racks 12B include connecting wings 111B, 112B stacked together and securely connected to each other by multiple bolt-nut sets 31B. Two of the positioning racks 12B are formed on and protrude from one of the baseboards 11B, and the other three positioning racks 12B are formed on and protrude from the other baseboard 11B. In addition, the numbers of the fixing boards 21B having the fixing hole 211B, of the through holes 222B formed through the first supporting mount 22B, of the through holes 252B formed through the second supporting mount 25B, of the screw bolts 223B of the first supporting mount 22B, and of the screw bolts 253B of the second supporting mounts 25B are each respectively equal to the number of the positioning racks 12B.

Figure 12:
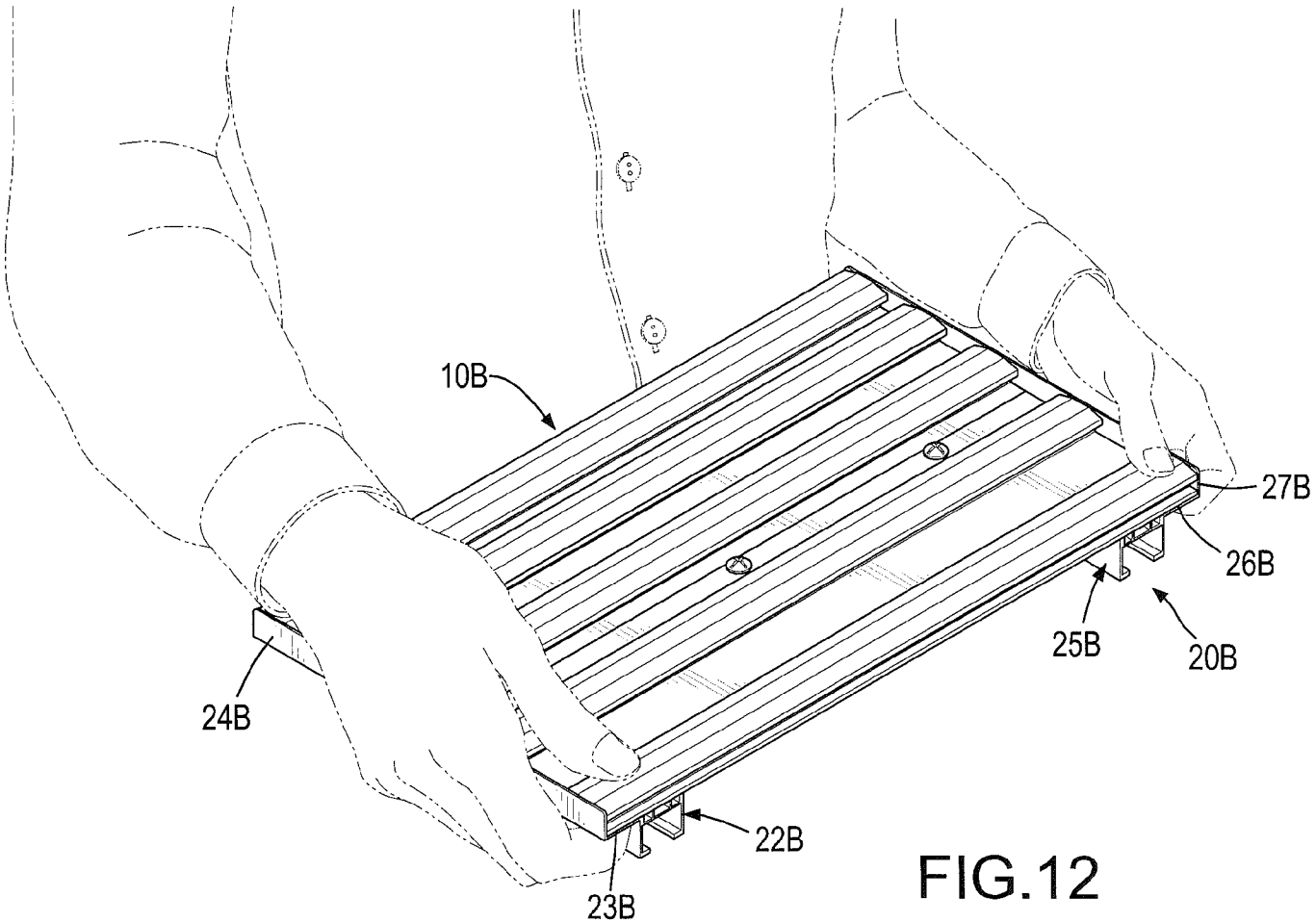
FIG. 12 is an operational perspective view of the positioning frame in FIG. 8.
Figure 13:
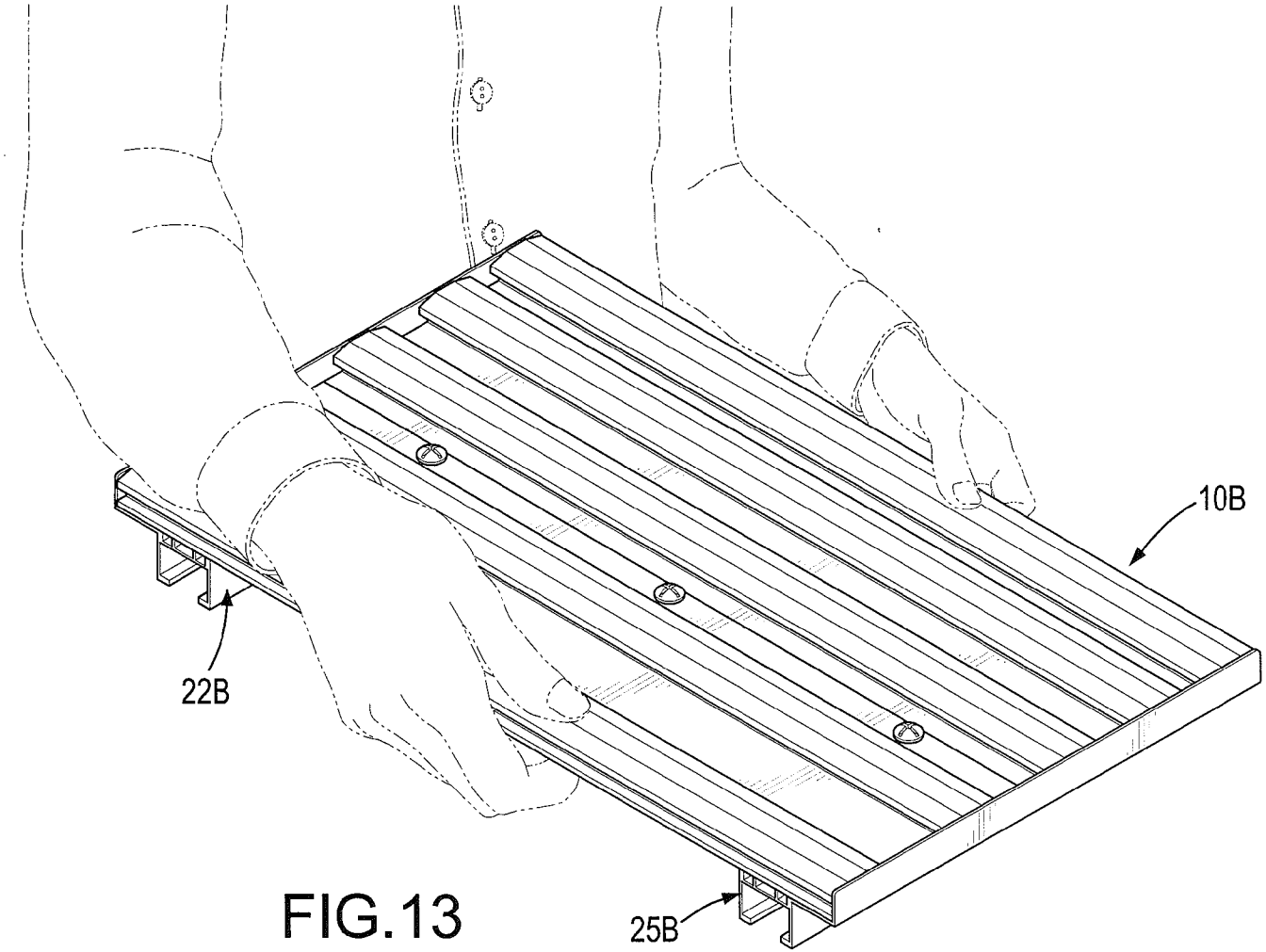
FIG. 13 is another operational perspective view of the positioning frame in FIG. 8.
Figure 14:
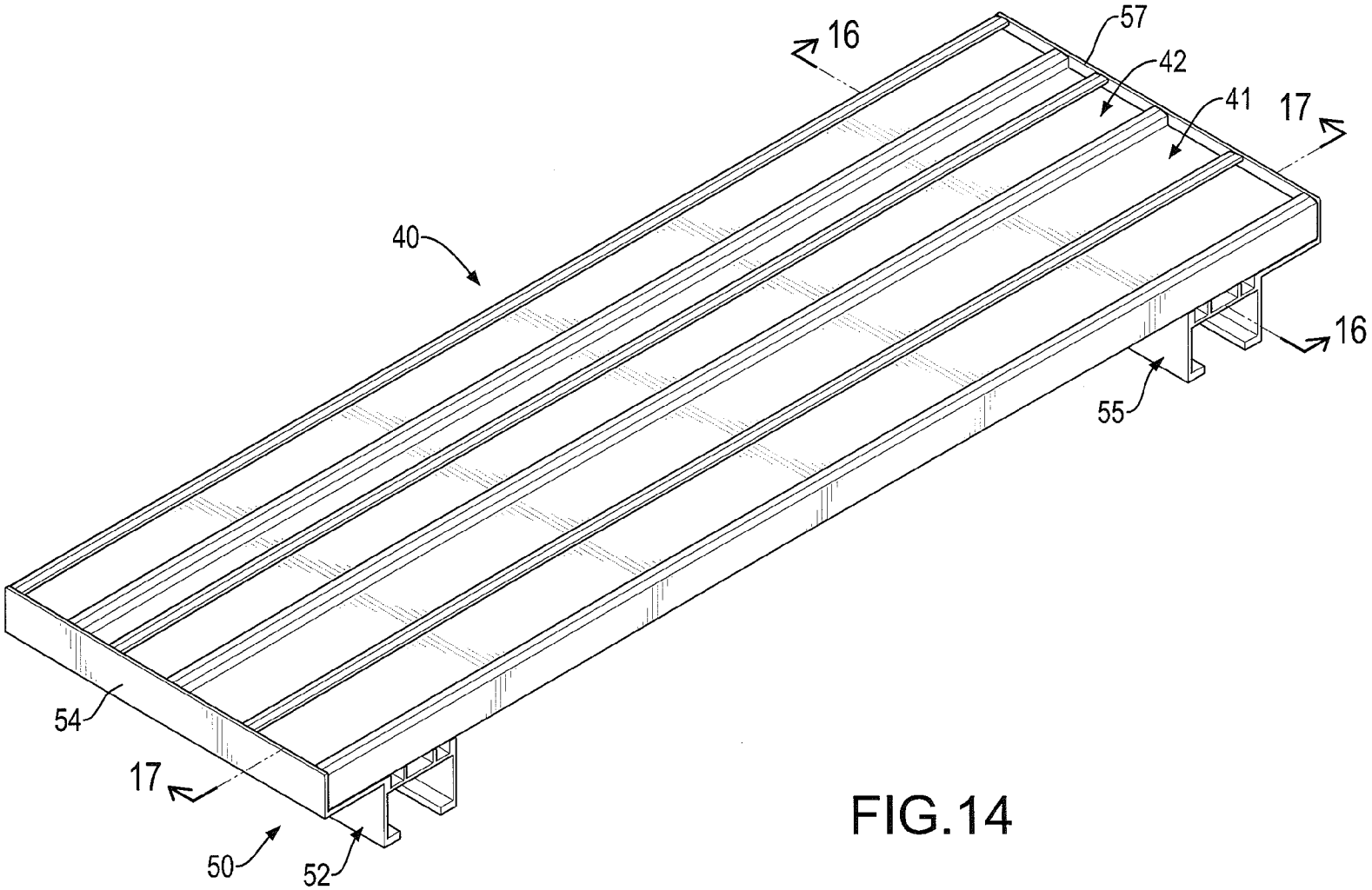
FIG. 14 is a perspective view of a fourth embodiment of a positioning frame in accordance with the present invention.
Figure 15:
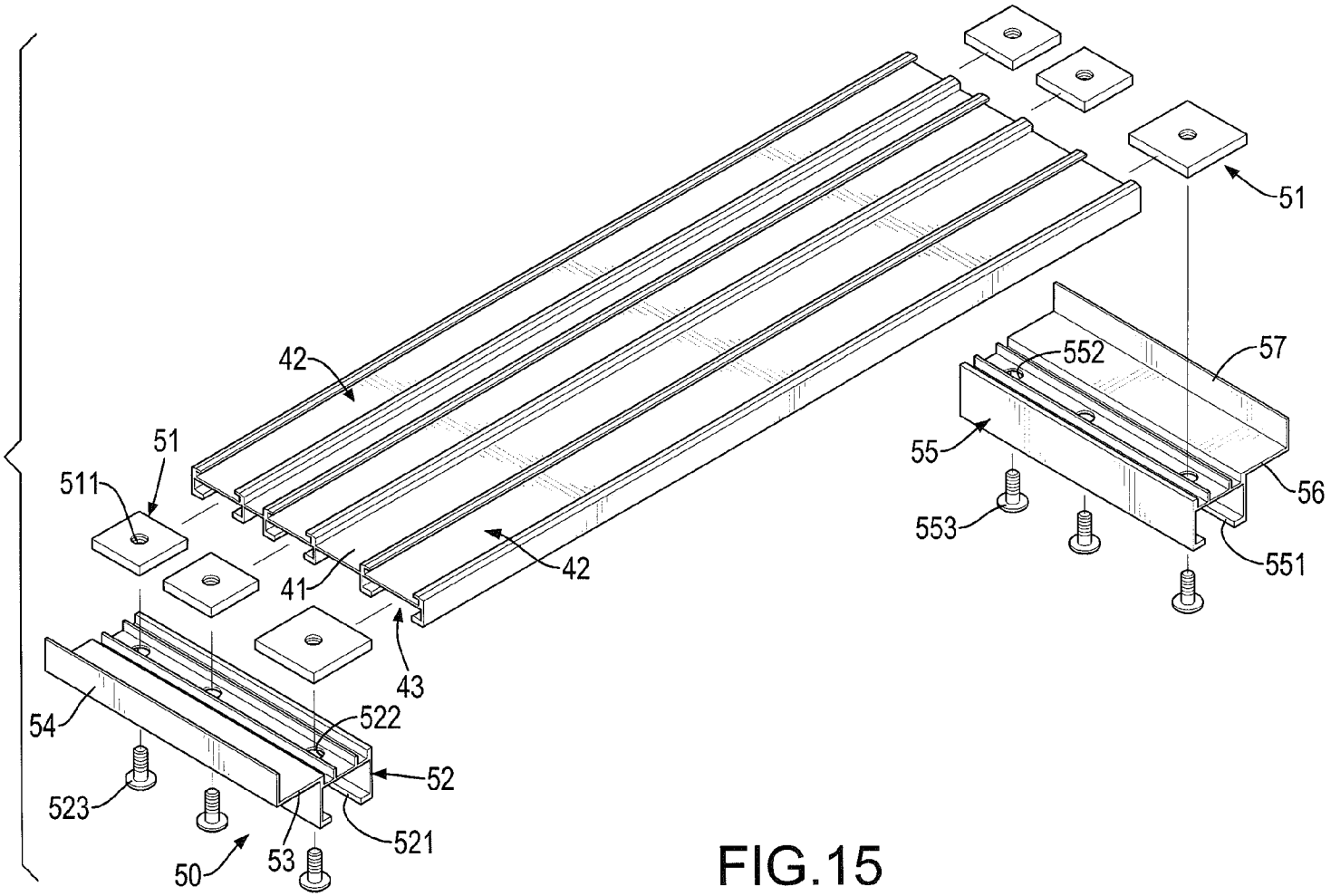
FIG. 15 is an exploded perspective view of the positioning frame in FIG. 14.

With reference to FIGS. 12 and 13, in the third embodiment of the positioning frame for socket bits, the supporting mounts 22B, 25B of the supporting device 20B include side panels 24B, 27B, extending tabs 23B, 26B, and through holes 221B and 251B. The supporting mounts 22B, 25B are mounted on and protrude from the bottom surface of the baseboard 11B, and this can provide a space between the supporting mounts 22B, 25B and the bottom surface of the baseboard 11B. Then, the positioning frame for socket bits can be held upward by a user inserting fingers into the space between the supporting mounts 22B, 25B and the bottom surface of the baseboard 11B at a transversal direction or a longitudinal direction without using the handle of the conventional positioning frame, and this can reduce the whole volume of the positioning frame in storage.

Figure 16:
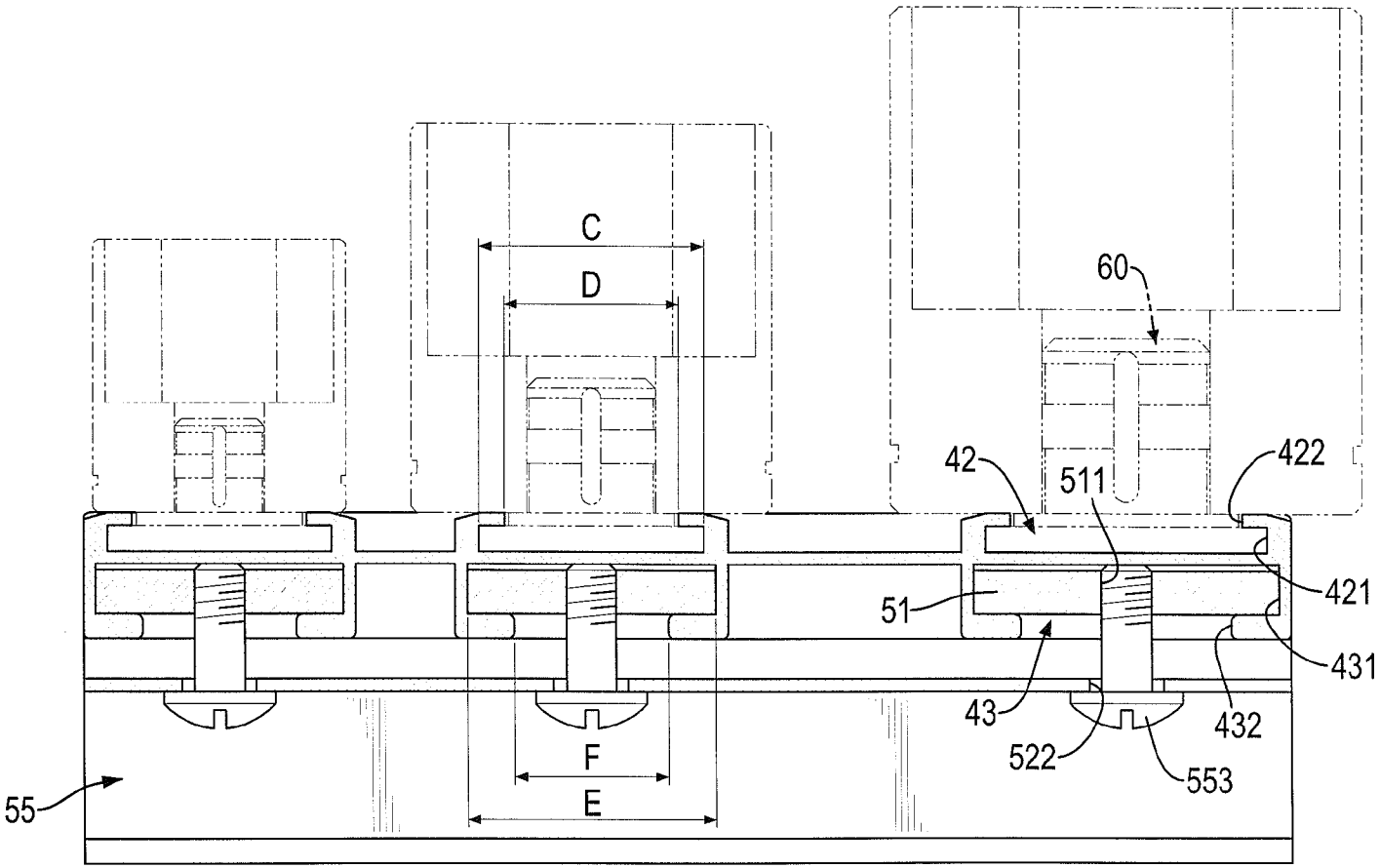
FIG. 16 is an enlarged cross sectional view in partial section of the positioning frame across line 16-16 in FIG. 14.
Figure 17:
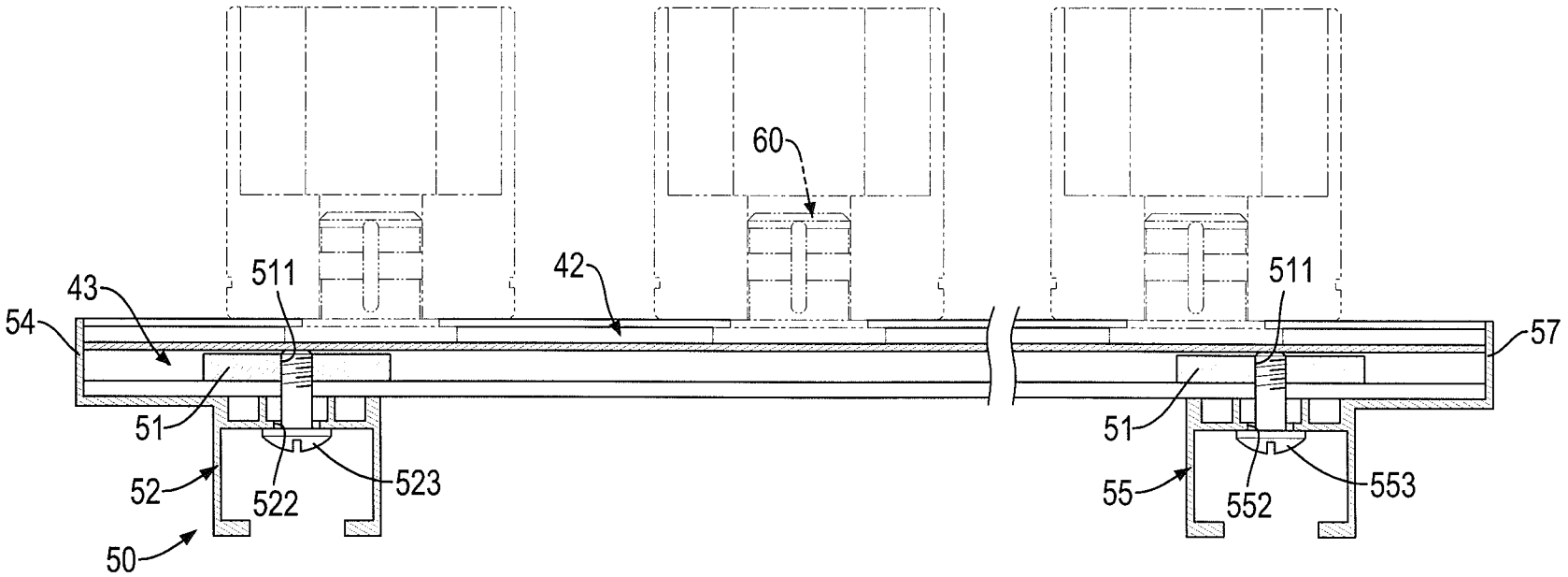
FIG. 17 is another enlarged cross sectional view in partial section of the positioning frame across line 17-17 in FIG. 14.

With reference to FIGS. 14 to 17, a fourth embodiment of a positioning frame for socket bits has similar structures substantially the same as the structures in the above-mentioned first embodiment of the positioning frame except the positioning racks 42 of the track frame 40 are formed in the top surface of the baseboard 41 at intervals, and each positioning rack 42 has a bottom side, a top side, a clamping slot 421 and an opening 422. The clamping slot 421 is formed in the bottom side of the positioning rack 42 and has a width (C). The opening 422 is formed through the top side of the positioning rack 42, communicates with the clamping slot 421 and has a width (D). The width of the clamping slot 421 of the positioning rack 42 is wider than the width of the opening 422 of the positioning rack 42. With further reference to FIGS. 16 and 17, multiple positioning blocks 60 can be mounted slidably on and clamp the positioning racks 42 of the track frame 40 to hold socket bits on the track frame 40. In addition, the structural relationship between the opening 422 and the clamping slot 421 of each one of the positioning racks 42 can prevent the corresponding positioning block 60 from departing from the clamping slot 421 of the positioning rack 42.

Furthermore, the holding racks 43 are formed in the bottom surface of the baseboard 41 at intervals and align with the positioning racks 42, and each holding rack 43 has a bottom side, a top side, a holding recess 431 and an opening 432. The holding recess 431 is formed in the bottom side of the holding rack 43 and has a width (E). The opening 432 is formed through the top side of the holding rack 43, communicates with the holding recess 431 and has a width (F). The width (E) of the holding recess 431 is wider than the width (F) of the opening 432 of the holding rack 43.

The supporting device 50 is detachably connected to the track frame 40 and has multiple fixing boards 51, a first supporting mount 52 and a second supporting mount 55. The fixing boards 51 may be quadrate, and are movably mounted in the holding recesses 431 of the holding racks 43 adjacent to the opposite sides of the baseboard 41. Each fixing board 51 has a fixing hole 511 formed through the fixing board 51 and communicating with the opening 432 of a corresponding holding rack 43. Since the width (E) of the holding recess 431 is wider than the width (F) of the opening 432, the fixing boards 51 will not depart from the holding recesses 431 of the holding racks 43 via the openings 432.

The first supporting mount 52 may be square, is made by aluminum extrusion and is connected to the bottom surface and one of the opposite sides of the baseboard 41. The first supporting mount 52 has a top, a bottom, an outer side, a through opening 521, multiple through holes 522, multiple screw bolts 523, an extending tab 53 and a side panel 54. The first supporting mount 52 of the fourth embodiment of the positioning frame has similar structures substantially the same as the structures of the first supporting mount 22 in the above-mentioned first embodiment of the positioning frame, and the description of the first supporting mount 52 is omitted.

The second supporting mount 55 may be square, is made by aluminum extrusion and is connected to the bottom surface and the other one of the opposite sides of the baseboard 51. The second supporting mount 55 has a top, a bottom, an outer side, a through opening 551, multiple through holes 552, multiple screw bolts 553, an extending tab 56 and a side panel 57. The second supporting mount 55 of the fourth embodiment of the positioning frame has similar structures substantially the same as the structures of the second supporting mount 25 in the above-mentioned first embodiment of the positioning frame, and the description of the second supporting mount 55 is omitted.

According to the above-mentioned descriptions, the positioning frame for socket bits in accordance with the present invention has the following advantages.

1. The supporting mounts 22, 25, 22A, 25A, 22B, 25B, 52, 55 are mounted on and protrude from the bottom surface of the baseboard 11, 11A, 11B, 41, and this can provide a space between the supporting mounts 22, 25, 22A, 25A, 22B, 25B, 52, 55 and the bottom surface of the baseboard 11, 11A, 11B, 41. Further, the positioning frame for socket bits in accordance with the present invention can be held upward by a user inserting fingers into the space between the supporting mounts 22, 25, 22A, 25A, 22B, 25B, 52, 55 and the bottom surface of the baseboard 11, 11A, 11B, 41 at a transversal direction or a longitudinal direction conveniently.

2. The supporting device 20, 20A, 20B, 50 has at least two supporting mounts 22, 25, 22A, 25A, 22B, 25B, 52, 55 mounted on the bottom surface of the baseboard 11, 11A, 11B, 41 to reinforce the structural strength of the track frame 10, 10A, 10B, 40. Then, when the positioning frame is used to mount a lot of socket bits or heavy tools, the structural strength of the positioning frame can bear the weight of the socket bits or the tools without distorting the positioning frame.

3. The positioning frame for socket bits in accordance with the present invention can be held upward by a user inserting fingers into the space between the supporting mounts 22, 25, 22A, 25A, 22B, 25B, 52, 55 and the bottom surface of the baseboard 11, 11A, 11B, 41 without using the handle of the conventional positioning frame, and this can reduce the whole volume of the positioning frame in storage.

4. The track frame 10, 10A, 10B, 40 of the positioning frame in accordance with the present invention has at least one positioning rack 12, 12A, 12B, 42 formed on or formed in the top surface of the baseboard 11, 11A, 11B, 41, and different quantities of positioning blocks 30, 60 can be mounted around or mounted in the at least one positioning rack 12, 12A, 12B, 42. The positioning frame in accordance with the present invention can be used to store socket bits according to the user's need conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A positioning frame for socket bits comprising:

a track frame made by aluminum extrusion and being elongated, with the track frame having:

first and second baseboards being rectangular in shape and connected to each other, with each baseboard having:

a top surface;

a bottom surface opposite to the top surface;

first and second opposite sides; and a length;

a positioning rack formed on the top surface of each of the first and second baseboards, with each positioning rack having a length equal to the length of each of the first and second baseboards; and a holding rack formed in said positioning rack, with each holding rack having:

a bottom side;

a length equal to the length of each baseboard;

a holding recess formed in the holding rack and having a width; and an opening formed through the bottom side of the holding rack, communicating with the holding recess and having a width narrower than the width of the holding recess; and a supporting device detachably connected to the track frame and having:

first and second fixing boards movably mounted in the holding recess of each of the first and second holding racks, with each fixing board having a fixing hole formed through the fixing board and communicating with the opening of a corresponding holding rack, wherein the first and second fixing boards mounted in the holding recesses of the first and second holding racks are aligned respectively; and first and second supporting mounts connected to the bottom surfaces of the first and second baseboards, with each of the first and second supporting mounts having:

a top;

a bottom;

an outer side; and first and second through holes formed through the top and respectively aligning with the fixing holes of the first and second fixing boards aligned with each other in the holding racks of the first and second baseboards, with each through hole having a screw bolt mounted through the through hole and securely mounted in the fixing hole of the corresponding fixing board via the opening of the corresponding holding rack to connect the supporting mount securely at the bottom surface of the corresponding baseboard, wherein the first supporting mount is connected to and protrudes from the bottom surfaces and one of the two opposite sides of the first and second baseboards and the second supporting mount is connected to and protrudes from the bottom surfaces and the other one of the two opposite sides of the first and second baseboards, with a space defined between the first and second supporting mounts beneath the bottom surfaces of the first and second baseboards opposite the positioning racks, wherein the first supporting mount has:

a first extending tab formed on and transversally protruding from the outer side of the first supporting mount, formed at the top of the first supporting mount, abutting the bottom surfaces of the first and second baseboards and having an outer side; and first side panel formed on and upwardly protruding from the outer side of the first extending tab to close the positioning racks and the holding racks of the first and second baseboards at the first opposite sides of the first and second baseboards as the first supporting mount; and wherein the second supporting mount has:

a second extending tab formed on and transversally protruding from the outer side of the second supporting mount, formed at the top of the second supporting mount, abutting the bottom surfaces of the first and second baseboards and having an outer side; and a second side panel formed on and upwardly protruding from the outer side of the second extending tab of the second supporting mount to close the positioning racks and the holding racks of the first and second baseboards at the second opposite sides of the first and second baseboards as the second supporting mount.

2. The positioning frame as claimed in claim 1, wherein each supporting mount has a through opening formed through the bottom of the supporting mount and communicating with the first and second through holes of the supporting mount.

3. The positioning frame as claimed in claim 2, wherein each of the first and second baseboards has:

an inner side; and a connecting wing formed on and protruding transversally from the inner side of the baseboard and stacked with the connecting wing of the other baseboard.

4. The positioning frame as claimed in claim 3, wherein:

each positioning rack is hollow and is formed on and protrudes from the top surface of each of the first and second baseboards and has:

two opposite sidewalls; and two clamping slots respectively formed in the two opposite sidewalls; and each holding rack is formed on the bottom surface of the each of the first and second baseboards and is formed in the positioning rack.

5. The positioning frame as claimed in claim 3, wherein each positioning rack has:

a bottom side;

a top side;

a clamping slot formed in the bottom side of the positioning rack and having a width; and an opening formed through the top side of the positioning rack, communicating with the clamping slot and having a width narrower than the width of the clamping slot of the positioning rack.

6. The positioning frame as claimed in claim 2, wherein:

each positioning rack is hollow and is formed on and protrudes from the top surface of each of the first and second baseboards and has:

two opposite sidewalls; and two clamping slots respectively formed in the two opposite sidewalls; and each holding rack is formed on the bottom surface of the each of the first and second baseboards and is formed in the positioning rack.

7. The positioning frame as claimed in claim 2, wherein each positioning rack has:

a bottom side;

a top side;

a clamping slot formed in the bottom side of the positioning rack and having a width; and an opening formed through the top side of the positioning rack, communicating with the clamping slot and having a width narrower than the width of the clamping slot of the positioning rack.

8. The positioning frame as claimed in claim 1, wherein:

each positioning rack is hollow and is formed on and protrudes from the top surface of each of the first and second baseboards and has:

two opposite sidewalls; and two clamping slots respectively formed in the two opposite sidewalls; and each holding rack is formed on the bottom surface of the each of the first and second baseboards and is formed in the positioning rack.

9. The positioning frame as claimed in claim 1, wherein each positioning rack has:

a bottom side;

a top side;

a clamping slot formed in the bottom side of the positioning rack and having a width; and an opening formed through the top side of the positioning rack, communicating with the clamping slot and having a width narrower than the width of the clamping slot of the positioning rack.

* * * * *